United States Patent [19]

Slobodnik

[11] Patent Number: 4,561,566

[45] Date of Patent: Dec. 31, 1985

[54] AUTO FLOW CONTROLLER

[76] Inventor: Lev Slobodnik, 185-01 Hillside Ave., Apt. 5-P, Jamacia, N.Y.

[21] Appl. No.: 576,370

[22] Filed: Feb. 2, 1984

[51] Int. Cl.[4] ..... B67D 5/08

[52] U.S. Cl. ..... 222/56; 222/67; 222/638

[58] Field of Search ..... 222/52, 56, 64, 68, 222/67, 638, 639, 14, 129, 333, 255; 141/198; 73/304 C, 304 R, 305, 426

[56] References Cited

U.S. PATENT DOCUMENTS

| | | | |
|---|---|---|---|
| 3,645,305 | 2/1972 | Warlop | 222/56 |
| 3,804,300 | 4/1974 | Cox | 222/67 |
| 3,985,267 | 10/1976 | Selvia et al. | 222/638 |
| 4,133,454 | 1/1979 | Arthur et al. | 222/56 |
| 4,377,246 | 3/1983 | McMillin et al. | 222/67 |
| 4,440,315 | 4/1984 | Slobodnik | 222/56 |

*Primary Examiner*—F. J. Bartuska
*Assistant Examiner*—Kenneth Noland
*Attorney, Agent, or Firm*—Richard I. Miller

[57] ABSTRACT

An auto flow controller which may be used to automatically release a number of component liquids which are to be transmitted to a mixing tank without constantly having to replenish the liquid component chemicals. A sensor located in a mixing tank is equipped with sensors which commands a set of storage containers to release a predetermined quantity of liquid component chemical. This quantity may be controlled by use of level graduated sensors which control pumps or solenoids or by means of a single sensor which initiates timer equipped pumps or solenoids. A combination of these methods may be used. Pump feed, gravity feed or combination of both are utilized.

2 Claims, 6 Drawing Figures

Fig. 2
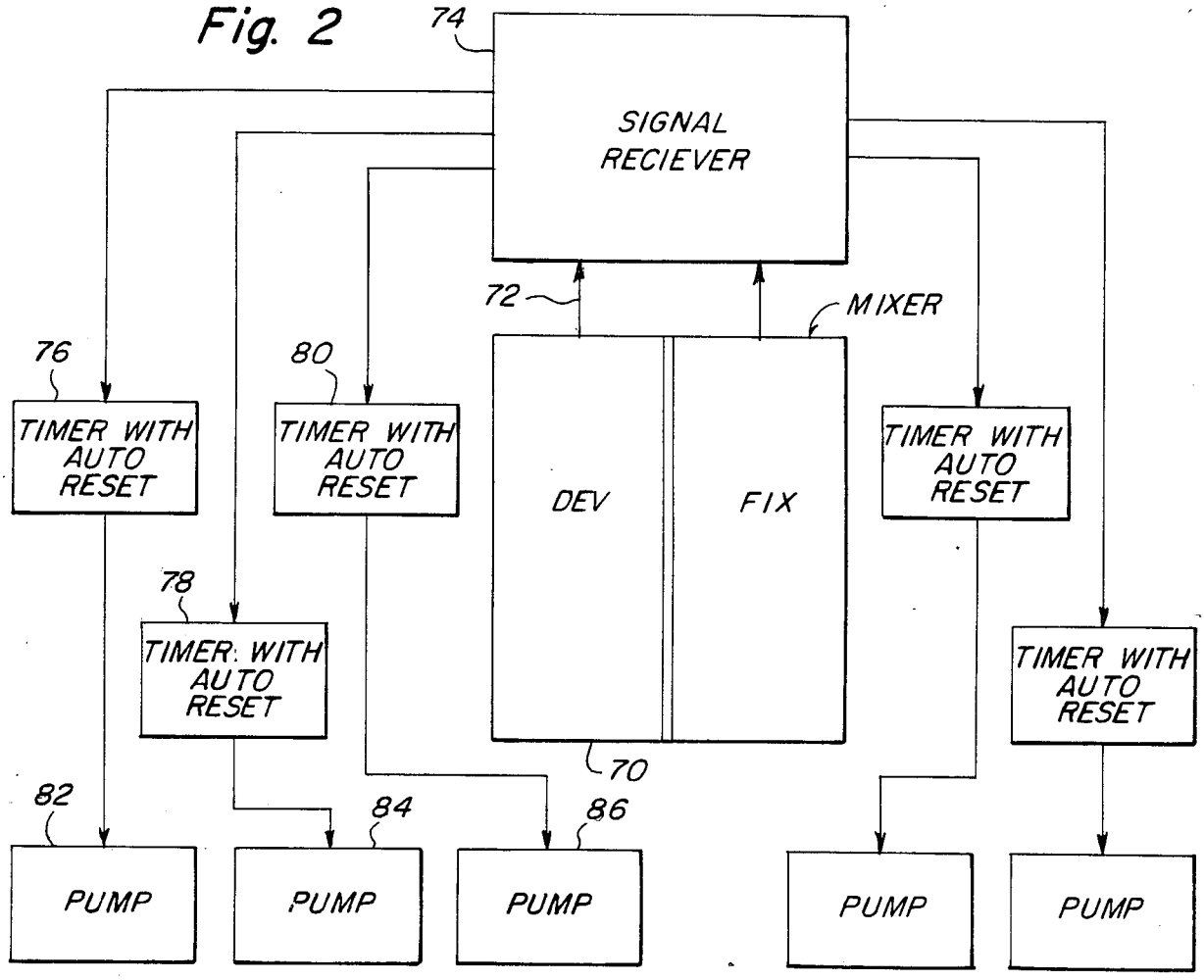
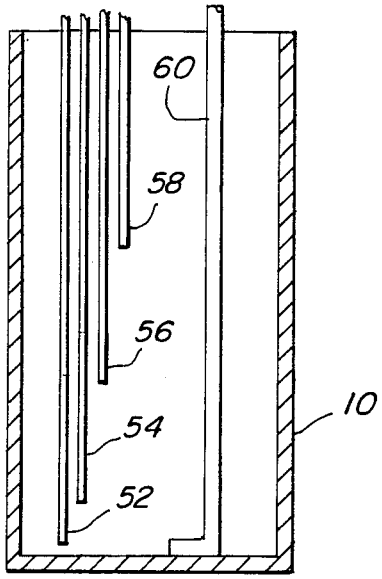
Fig. 3A
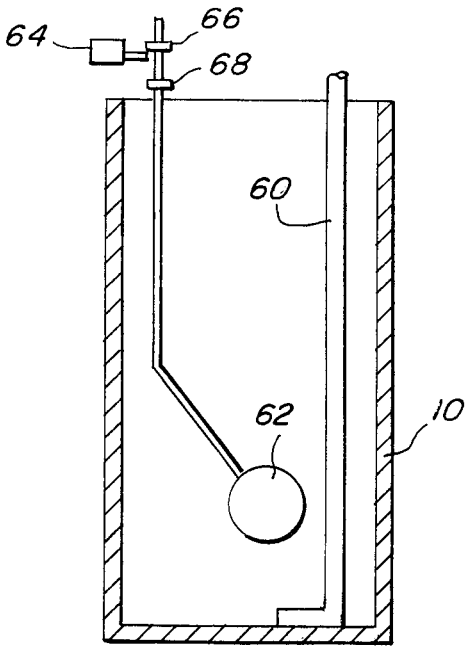
Fig. 3B

AUTO FLOW CONTROLLER

BACKGROUND OF THE INVENTION

This invention relates to an automatic flow controller and more particularly to a flow controller which automatically provides the necessary ingredients to an automatic mixing device. Although any types of liquids may be mixed, an X-ray photographic development situation will be used as an exemplary case in point.

In a typical hospital, photo laboratory, or Radiology Department, a considerable number of X-ray and other films are processed on a regular basis. In order to process such films a developer solution and a fixer solution are needed. The developer solution is typically formed of a combination of ingredients in conjunction with water. Similarly, the fixer solution combines various ingredients in combination with water to form the proper solution. Typically, three ingredients are utilized to form the developer solution and two ingredients form the fixer solution.

In most situations, an automatic mixing device is utilized to form the proper developer and fixer solutions. Such equipment is readily available, with one such piece of equipment being the Kodak Automixer, which is commercially available from the Eastman Kodak Company. In this device, as well as with other similar devices, three individual containers are inverted and placed into appropriate compartments on one side of the Automixer and two containers are inverted and placed in appropriate compartments on the opposing side of the Automixer. The three containers provide their ingredients in conjunction with water to form the developer solution, while the other two containers provide their ingredients, together with water, to provide a fixer solution.

While such devices are readily utilized in situations where a large number of films must be processed on a regular basis, there is so much continued changing and replacing of the various containers in the Automixer as to become an almost intolerable burden. Where large volumes of film must be developed, the containers providing the developer and fixer ingredients must be changed at almost hourly intervals. This continuous replenishing process is one that is most inconvenient, in addition to being expensive and time consuming. Also, it is quite costly to provide the developer and fixer ingredients in small containers.

Accordingly, while the Automixers are of considerable importance, it would be beneficial if a continuous supply of ingredients could be provided to the Automixer. However, the supply to the Automixer must be such that the ingredients are provided in predetermined quantities. Thus, each time the Automixer is replenished, the ingredients must be provided in a predetermined amount in order to maintain the necessary proportions for the developer and fixer mixture solutions. However, while such predetermined amounts must be provided, it will be convenient if there could also be a continuous supply to the Automixer.

In co-pending application Ser. No. 323,652 filed 11/20/81 now U.S. Pat. No. 4,440,315 the inventor proposed a system in which each of the component solutions was transported to an intermediate holding container which was allowed to fill to some predetermined level at which point the filling of this intermediate container would stop by means of a level switch and flow valve. An emptying valve would permit the exit of the premeasured contents of the intermediate container to the main mixing tank.

SUMMARY OF THE INVENTION

It is therefore, a primary object of the present invention to provide an auto flow controller with a number of alternative techniques for controlling the delivery of various liquid component chemicals to a mixing tank.

It is another object to provide an auto flow controller to control liquid chemical delivery which consists of a detector which detects the level of each liquid component chemical as it is added to the mixing tank by detecting the change in electrical resistance between a number of electrical sensors placed at different levels in the mixing tank.

It is yet another object to provide an auto flow controller to control liquid chemical delivery in which the pump "on" time of each pump determines the composition of the solution.

A yet further object is to provide an auto flow controller which may initiate refilling of the mixing tank by either a system of electrical contacts which contact the liquid directly or a system which consists of a float which rests upon the surface of the mixed liquid component chemical and associated microswitch which is activated by the float. In either case, a signal receiver will be provided which processes signals from either a system of electrical contacts or float and microswitch, and activates switches (for pumps) or solenoids (of valves) to transport component chemicals to the mixing tank.

A still further object is to provide an autoflow controller which may deliver component chemicals to a mixing tank using either pumps or gravity feed.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The FIGS. in the drawings are briefly described as follows:

FIG. 2 is an electronic block diagram of an alternative embodiment of the invention showing the flow of electrical control signals.

FIG. 3A is a cross sectional view of the developer mixing tank of the invention as shown in FIG. 1, showing a system of electrical level sensors.

FIG. 3B is a cross sectional view of the mixing tank of the invention showing an alternative system of float and microswitch.

DETAILED DESCRIPTION OF THE PREFERRED EMBODIMENT

Figure 1:
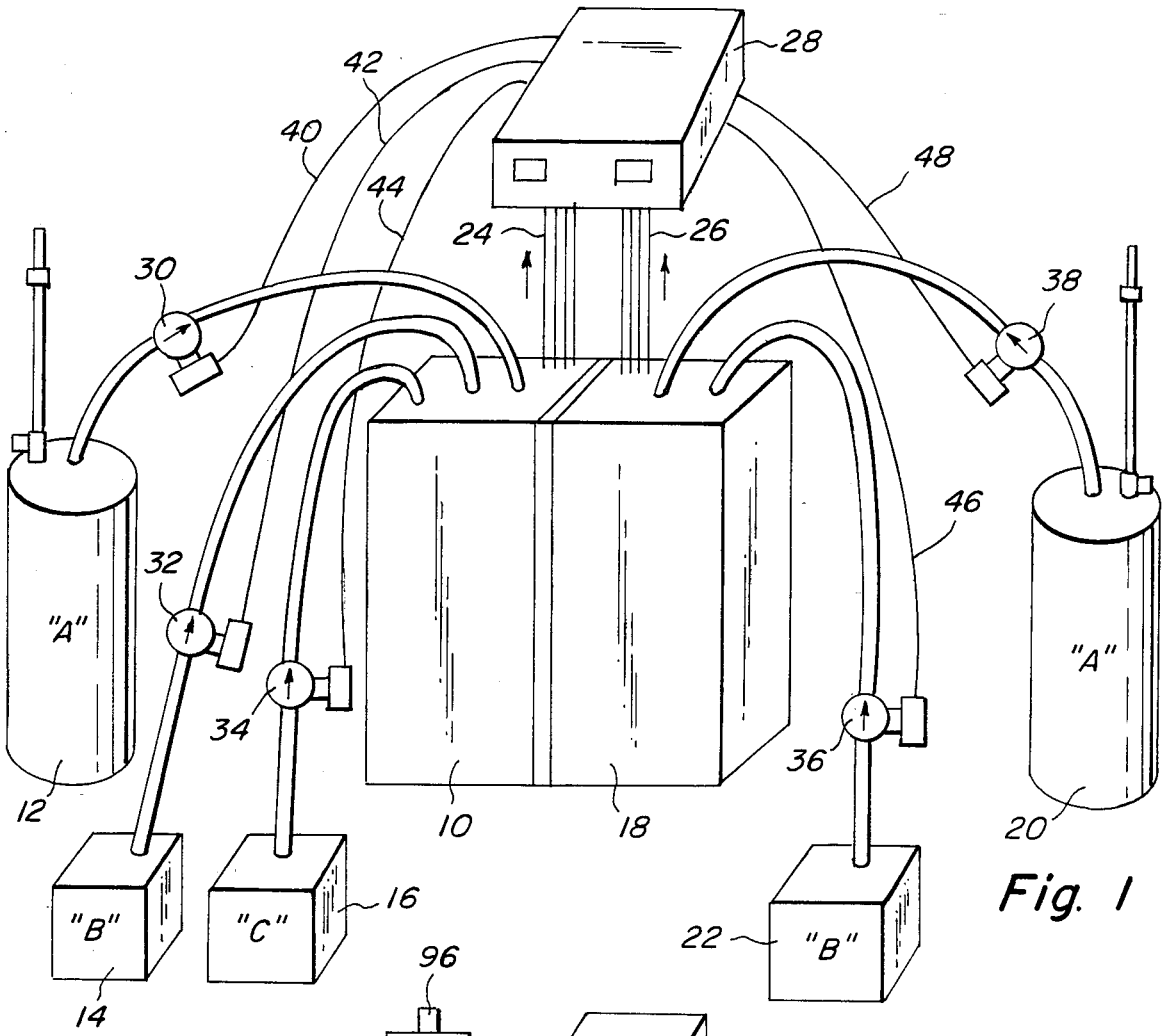
FIG. 1 is a diagrammatic perspective view of the invention with pump feed.

Referring now to FIG. 1, developer mixing tank 10 is to receive an appropriate quantity of liquid component chemical "A" from container 12, an appropriate quantity of liquid component chemical "B" from container 14 and an appropriate quantity of liquid component chemical "C" from container 16. Fixer mixing tank 18 is to receive an appropriate quantity of liquid component chemical "B" from container 22. Containers 12 and 20 are shown larger than containers 14, 16 and 22 because one component of chemical solution is often present in greater quantity than the others. The outputs of probes located in developer tank 10 and fixer tank 18 are available as developer probe output bus 24 and fixer probe output bus 26. These signals are picked up by a signal receiver 28 and activate in appropriate sequence electrically operated pumps 30 and 38, and timer equipped pumps 32,34 and 36 via power cables 40,42,44,46 and 48 respectively. This correct timing and sequencing may best be understood by reference to FIGS. 1 and 3A. Sensor 52 acts as a common electrical connection for all other sensors and therefore extends to the bottom of developer mixing tank 10. When the level of the liquid component chemical mixture in developer mixing tank 10 falls below the bottom of sensor 54 the electrical resistance between sensors 52 and 54 suddenly increases. This increase is sensed by signal receiver 28 which turns on pump 30 causing liquid component chemical "A" from container 12 to be pumped into developer mixing tank 10. When the level of liquid component chemical "A" reaches the bottom of sensor 56 signal receiver 28 turns off pump 30 and turns on timer pumps equipped with pumps 32 and 34, which continue pumping until their respective timers reach their preset intervals. It is necessary to add water to the solution, a water controlling solenoid valve is activated when the liquid component chemical level reaches 56 and is terminated when liquid component chemical level reaches the bottom of sensor 58. Once the mix is complete it exits developer mixing tank 10 via outlet siphon 60.

Figure 5:
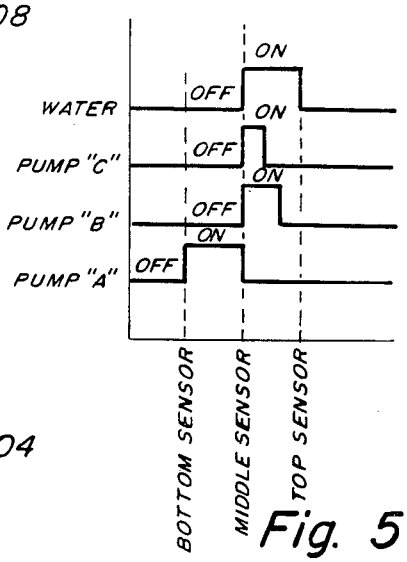
FIG. 5 is a timing diagram of the invention in FIG. 1 and FIG. 3A.

An understanding of this embodiment of the invention may also be obtained with reference to timing diagram FIG. 5. As may be seen from the timing on/off pulse train pump "A" numeral 30 in FIG. 1. runs from the time bottom sensor 54 in FIG. 3A is contacted until middle sensor 56 in FIG. 3A is contacted. Pump "B", numeral 32 in FIG. 1 runs from the time middle sensor 56 in FIG. 3A is contacted until its own internal timer shuts it off. If water is desired, a water control solenoid may be activated when middle sensor 56 in FIG. 3A is contacted and shut off when top sensor 58 in FIG. 3A is contacted.

It may be desired to have only a single pair of electrical sensors or a single float and microswitch combination. The single float is shown as 62 in FIG. 3B, with microswitch 64 and top limit stop 66 and bottom limit stop 68. When float 62 falls below some predetermined level the switch contacts on microswitch 64 are closed which transmits a "refill" signal to signal receiver 28 in FIG. 1. It is understood that a single pair of electrical sensors, such as sensors 52 and 54 in FIG. 3A could also have been used. In either case this situation could be represented, in terms of signal flow by reference to FIG. 2. If the liquid component chemical in developer mixing tank 70 falls below some predetermined level a signal is sent to signal receiver 74 which initiates timers with auto reset 76,78 and 80 to activate pumps 82, 84 and 86 respectively to run for preset times, thereby delivering a predetermined quantity of liquid component chemical from each container. An analogous situation exists with regard to the fixer mixing tank.

Figure 4:
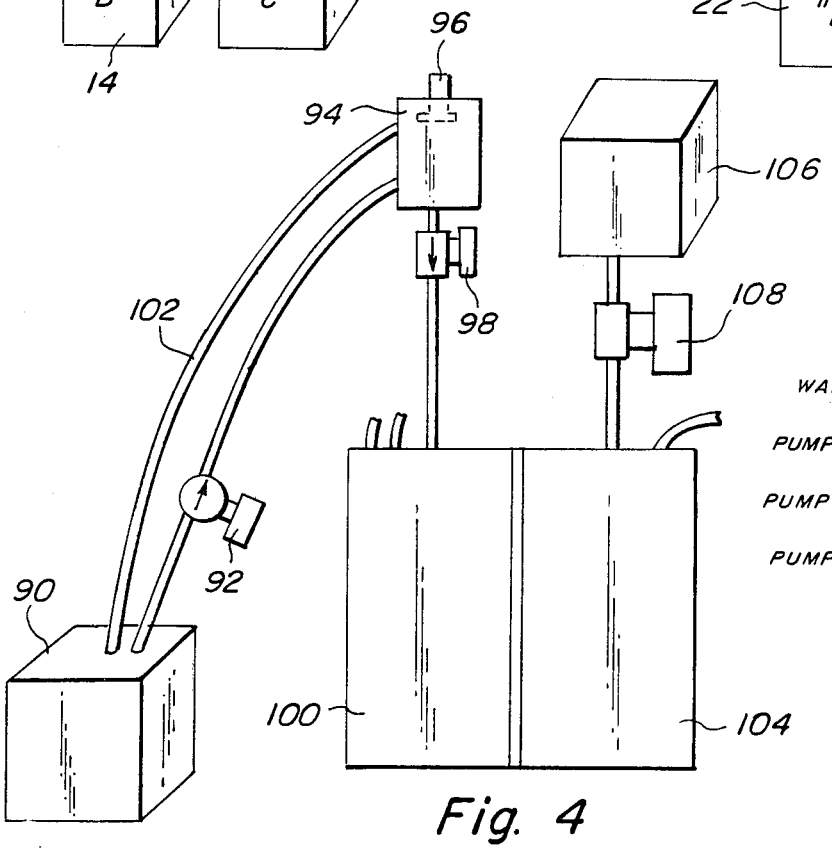
FIG. 4 is a partial diagrammatic perspective view of the invention showing gravity feed.

Instead of using pump feed it may be desired to use gravity feed. FIG. 4 demonstrates how this may be accomplished. One of a plurality of developer liquid component chemical containers is represented by a typical container 90. Developer mixing tank full signal is used to activate pump 92 which lifts liquid component chemicals from container 90 into an intermediate measuring container 94. When a predetermined level is reached, limit switch with float 96 stops pump 92 Solenoid valve 98 releases a predetermined quantity of the liquid component chemical into developer mixing tank 100, when empty signal activates solenoid valve 98. As a safety precaution, should pump 92 not shut off, an overflow tube 102 is provided to route the liquid component chemical back to container 94. This process may be initiated by either the float or electrical sensor system already enumerated. For smaller volumes of liquid component chemicals which may be easily lifted to a level above the mixing tanks a pump is not necessary. This is demonstrated in FIG. 4 where fixer mixing tank 104 may be filled with liquid component chemical held, for example, in typical container 106 and released to fixer mixing tank 104 via timer controlled solenoid valve 108 which may be initiated by the previously enumerated float or electrical sensor systems. Since the rate of discharge of container 106 will vary with the head of liquid component chemical contained therein, if greater accuracy of discharge to fixer mixing tank 104 is desired the timing duration of timer controlled solenoid 108 may be increased as container 106 empties, by appropriate electronic circuitry.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. An auto flow controller for controlling quantity of various liquid components delivered to a mixing tank in which a solution is to be prepared, comprising in combination:

a plurality of mixing tanks;

a plurality of holding containers to store liquid components of solution to be mixed in said mixing tanks;

means for causing said liquid components to be carried to said mixing tank;

means for initiating the re-filling of said mixing tank when said mixing tank falls below some predetermined level; and means for controlling precisely the quantity of each of said liquid components which are carried to said mixing tank, wherein said means for controlling precisely the quantity of each of said liquid components which are carried to said mixing tank comprises a float which initiates the refilling process by activating a micro switch when said mixture falls below a predetermined level; pumps which cause said liquid components to be conducted to said mixing tanks for as long as said pumps are activated, timers with auto reset which activate said pumps and a signal receiver which senses the closure of the contacts of said micro switch and causes each of said timers to start thereby causing each of said pumps to deliver a predetermined amount of liquid to said mixing tank.

2. An auto flow controller for controlling quantity of various liquid components delivered to a mixing tank in which a solution is to be prepared, comprising in combination:

a plurality of mixing tanks;

a plurality of holding containers to store liquid components of solution to be mixed in said mixing tanks;

means for causing said liquid components to be carried to said mixing tank;

means for initiating the re-filling of said mixing tank when said mixing tank falls below some predetermined level; and means for controlling precisely the quantity of each of said liquid components which are carried to said mixing tank, wherein said means for controlling precisely the quantity of each of said liquid components which are carried to said mixing tank comprises a pair of electrical sensors one of which is placed at the bottom of said tank and the other of which is placed in said mixing tank at a level at which refill is to begin; pumps which cause said liquid components to be conducted to said mixing tanks for as long as said pumps are activated; timers with auto reset which activate said pumps and a signal receiver which senses the increase of resistance when said mixture level falls below higher of said pair of sensors and causes each of said timers to start thereby causing each of said pumps to, deliver a predetermined amount of liquid to said mixing tank.

* * * * *